US008342766B2

(12) United States Patent
Reshef-Gozlan

(10) Patent No.: US 8,342,766 B2
(45) Date of Patent: Jan. 1, 2013

(54) FRAGRANCE TESTER AND METHOD OF APPLYING A FRAGRANCE

(75) Inventor: Vered Reshef-Gozlan, Tel Aviv (IL)

(73) Assignee: Itmakesense Ltd, Tel Aviv (IL)

( * ) Notice: Subject to any disclaimer, the term of this patent is extended or adjusted under 35 U.S.C. 154(b) by 1465 days.

(21) Appl. No.: 11/887,321

(22) PCT Filed: Mar. 30, 2006

(86) PCT No.: PCT/IL2006/000401

§ 371 (c)(1),
(2), (4) Date: Sep. 28, 2007

(87) PCT Pub. No.: WO2006/103670

PCT Pub. Date: Oct. 5, 2006

(65) Prior Publication Data

US 2009/0142123 A1 Jun. 4, 2009

(30) Foreign Application Priority Data

Mar. 31, 2005 (IL) ..... 167810

(51) Int. Cl.
*B43K 29/00* (2006.01)

(52) U.S. Cl. ..... 401/195

(58) Field of Classification Search ..... 401/196, 401/195
See application file for complete search history.

(56) References Cited

U.S. PATENT DOCUMENTS

| | | | | |
|---|---|---|---|---|
| 4,244,525 | A * | 1/1981 | Manna | 239/289 |
| 4,432,281 | A | 2/1984 | Wall et al. | |
| 4,852,489 | A | 8/1989 | Wall et al. | |
| 5,579,692 | A | 12/1996 | Collier | |
| 5,623,875 | A * | 4/1997 | Perets | 101/334 |
| 5,715,849 | A * | 2/1998 | Vanbraekel | 132/314 |
| 6,474,892 | B2 * | 11/2002 | Chao | 401/195 |
| 2002/0013108 | A1 * | 1/2002 | Dobler | 442/96 |
| 2004/0165935 | A1 | 8/2004 | Kauffmann et al. | |

FOREIGN PATENT DOCUMENTS

| | | | |
|---|---|---|---|
| CH | 694 884 | A5 | 8/2005 |
| EP | 0 803 372 | A1 | 10/1997 |
| FR | 2 843 371 | A1 | 2/2004 |
| KR | 20010016382 | A | 3/2001 |

* cited by examiner

*Primary Examiner* — Huyen Le
(74) *Attorney, Agent, or Firm* — Vorys, Sater, Seymour and Pease LLP; Susanne M. Hopkins

(57) ABSTRACT

A fragrance tester for applying a fragrance comprising a mechanism for providing a visible indication and a fragrance applicator for applying the fragrance, the tester adapted to apply the fragrance in proximity of said visible indication.

28 Claims, 7 Drawing Sheets

FRAGRANCE TESTER AND METHOD OF APPLYING A FRAGRANCE

CROSS-REFERENCE

This is a National Phase Application filed under 35 U.S.C. 371 of International Application No. PCT/IL2006/000401, filed Mar. 30, 2006, the entire content of which is hereby incorporated herein by reference in its entirety.

FIELD OF THE INVENTION

The present invention is generally in the field of fragrance testers, of the type employed in perfumeries or other commercial outlets in which fragrances are sold to the public. The term "fragrance" as used herein throughout is meant to include, although not limited only thereto, perfumes, eau de toilette, after-shaves, deodorants, and the like

BACKGROUND OF THE INVENTION

Presently, when a consumer wishes to purchase a new fragrance in a perfumery, department store, pharmacy, duty-free shop or the like, the consumer is usually provided with a tester bottle of the particular fragrance, from which the consumer usually sprays a small amount on her/his hand or arm and then, after rubbing same into her/his skin, smells the area of the fragrance to determine if it is desirable and is compatible with that person's skin. Often after interacting with the skin, the customer may determine that the fragrance does not suit him/her. When presented with a choice, which presently is a very substantial choice in view of the myriad of different fragrances both old and new on the market from the various cosmetic and fashion companies, the present testing procedure is somewhat cumbersome, is confusing and is generally not "user-friendly". For example, if a consumer is presented with five new fragrances to test, after spraying, or otherwise applying all of them onto different parts of his/her hand and/or arm, the consumer usually does not recall which fragrance spot corresponds to which tester bottle, i.e. is confused, making the process of choosing very difficult.

To address this problem, many fragrance producers provide fragrance-strips with their logo or brand name, onto which is applied the new fragrance to be evaluated by the consumer. In this way the consumer is able to identify the, for example, five new fragrances he/she wishes to test, each being applied onto a different logo or brand-identified strip, thereby making the choice process simpler. However, this solution to the problem is not ideal. It is well known that the interaction between the fragrance and a person's skin differs from person to person, so often a pleasant fragrance on a fragrance-strip becomes less pleasant when the same fragrance is applied to the skin of one person, whereas for another person the fragrance remains pleasant.

Accordingly, in view of the above drawbacks of the fragrance testers currently in use, which have been in use for many years, there has been a long-felt need to provide the consumer with a fragrance tester that will both permit the direct application of the fragrance onto the skin and provide definite logo and/or brand name and/or promotional slogan and/or picture or visual image identification for each different fragrance applied onto the skin of the consumer wishing to test a number of fragrances at the same time, thereby making an informed choice of which is the most desirable fragrance for that particular consumer both in terms of the fragrance itself and the compatibility thereof with the skin.

As will be detailed hereinbelow, a preferred device for the purposes of the new fragrance tester of the present invention is one based on the well-known ink stamp devices, generally used in offices worldwide for stamping dates, addresses, short messages, and the like onto incoming mail, or onto outgoing mail. None of these stamp devices has been employed for the specific purpose of fragrance testing in accordance with the present invention. Likewise, none have been structurally and/or functionally modified for the purpose of fragrance testing. In accordance with the present invention, any of the known ink stamp devices may be modified to render them to be fragrance testers of the invention. Examples of such known ink stamp devices are those disclosed in U.S. Pat. Nos. 4,432,281 and 4,852,489, and European Patent No. EP 0803372, which describes the well-known self-inking stamping devices in widespread use worldwide, as well as the various self-inking devices widely marketed by, for example, companies like Trodat and M & R Marking. These all have a spring operated mechanism which enables the invertible stamp carrying platen to be in contact with the ink pad holder when the device is not in use and when the user applies downward pressure from the top and/or sides of the device, the stamp carrying platen is inverted, moved downwards and onto the surface of the paper, envelope or the like, onto which it prints the stamp carried by the platen. When released the stamp carrying platen re-inverts to its resting position, is drawn back into the device where it is brought into contact with the ink pad, where it is re-inked to render it ready for the next stamping operation. In many of these devices there is now provided a removable ink pad tray which is inserted/removed from the device for the purpose of replenishing the ink supply when necessary. The contents of the above noted patents as well as the readily apparent components of the commercially available self-inking ink stamp devices from companies such as Trodat and M & R Marking, are included herein by way of reference, particularly as concerns the basic mechanisms of these devices as used in the fragrance testers of the present invention.

It is therefore an object of the present invention to provide a fragrance tester which overcomes the drawbacks of the current fragrance testers. Particularly, it is an object of the present invention to provide a fragrance tester adapted for applying onto a person's skin a sample of the fragrance to be tested and applying an identifying logo or brand name of the fragrance being tested.

It is a further object of the present invention to provide a method of fragrance testing whereby a sample of the fragrance to be tested is applied to the person's skin together with an identifying logo or brand name of the fragrance in proximity to the fragrance sample.

These and other objects of the present invention will be described in greater detail in the non-limiting description of the present invention hereunder.

SUMMARY OF THE INVENTION

Accordingly, the present invention provides a fragrance tester for applying a fragrance comprising a mechanism for providing a visible indication and a fragrance applicator for applying the fragrance, the tester adapted to apply the fragrance in proximity of said visible indication.

The term "proximity" hereinafter in the specification and claims will be used in its broadest sense and includes application of the fragrance at the same location or adjacent the visible identification produced on the skin by the fragrance tester. Moreover, the fragrance tester of the present invention may include designs wherein the fragrance and visible indication (e.g. ink) are components in the same solution or mixture.

In accordance with a particular embodiment, the fragrance tester comprises a dual ink and fragrance reservoir and a dual ink stamp-carrying and fragrance applicator-carrying platen, wherein the dual ink and fragrance reservoir has separate ink and fragrance reservoirs and means for preventing a mixing of ink and fragrance, wherein the dual ink stamp-carrying and fragrance applicator-carrying platen has means for preventing a mixing of ink and fragrance, and wherein the fragrance tester has means for applying the dual ink stamp-carrying and fragrance applicator-carrying platen to a surface to be stamped therewith to provide a double stamp of fragrance and ink adjacent to each other on the surface.

The aforesaid fragrance tester of the invention provides for the stamping of a particular fragrance to be tested directly onto the skin of a person, together with an adjacent identifying logo/brand name and/or visual image and/or promotional slogan of the fragrance which is being tested by the tester. This allows the person to make a choice based on how the fragrance smells on his/her skin knowing with certainty what that fragrance is. In this way, using a number of such testers, each carrying a different fragrance, a person may readily stamp a number of different fragrances on his/her arm, know exactly which fragrance stamp is which and after comparing them make a fully informed choice which fragrance is most desirable to that person.

According to another embodiment, the fragrance tester of the invention has a dual ink stamp-carrying and fragrance applicator-carrying platen facing the surface to be stamped (the person's skin), wherein the dual ink and fragrance reservoirs are directly above the platen, and wherein the means for applying the platen to the surface is a handle/grip upon which downward pressure is applied when the platen is on the surface, the greater the pressure applied the more intensely the dual fragrance and ink stamps are applied to the surface. Various other mechanisms may be used wherein for applying the fragrance and logo, for example, a squeezing force on the sides of the tester, a trigger-type mechanism and so on.

In another embodiment the fragrance tester of the invention has the means for applying the dual platen to the surface comprising a stamper device having a movable housing functionally connected to a frame member and containing a spring, the frame member carrying the dual ink and fragrance reservoirs directly in contact with an invertibly movable dual ink stamp-carrying and fragrance applicator-carrying platen, when the fragrance tester is in a resting position with the spring being in its resting position, the frame member have a base member with an opening, wherein when a stamping operation is performed the housing is forced downwards by a user applying downward pressure causing the platen to disassociate from the dual ink and fragrance reservoirs to invert and to move downwards until opening in the base where the platen meets the surface upon which the base is placed, to stamp the double stamp of fragrance and ink adjacent to each other on the surface, and wherein when the platen moves downwards the spring is compressed and once the downward pressure is released after stamping the spring recoils back to its the resting position facilitating the return and re-inversion of the platen to its resting position in contact with the dual reservoirs.

In a further embodiment, the fragrance tester of the invention has the housing in the shape of a container, for example the bottle or canister in which the fragrance being tested by the tester is usually marketed.

In a further embodiment, the fragrance tester of the invention has the housing comprising on its front and/or top and/or back side a logo and/or visual image and/or brand name and/or picture and/or promotional slogan of the fragrance which is being tested by the tester.

In a yet further embodiment, the fragrance tester of the invention has the dual ink and fragrance reservoir comprising a channel between the ink and fragrance reservoirs, preventing the mixing of ink and fragrance.

In yet another embodiment, the fragrance tester of the invention has a spacer placed in the channel between the ink and fragrance reservoirs to prevent any possible mixing of ink and fragrance.

In a still further embodiment, in the fragrance tester of the invention, the dual ink stamp-carrying and fragrance applicator-carrying platen has a channel between the ink stamp and fragrance applicator, preventing any mixing of fragrance and ink when the platen is applied to the skin surface on which the dual stamp is to be applied.

In yet another embodiment, the fragrance tester of the invention has the fragrance reservoir of the dual fragrance and ink reservoir incorporating one or more one-way valves for applying fragrance onto the fragrance applicator carried by the platen.

In another embodiment, for the fragrance tester of the invention, the ink to be used on the ink stamp is a non-permanent ink of a readily washable type.

In a further embodiment, for the fragrance tester of the invention, the ink is of an invisible type, not visible under normal lighting, but visible once placed under an ultra-violet light/lamp. Further, the visible indication could be of any suitable material that provides a visible indication, e.g. paint, etc., and the term "ink" herein the specification and claims will be used to denote all of these.

In yet another embodiment, in the fragrance tester of the invention, the dual ink and fragrance reservoir is in the form of a removable cassette, which is inserted/removed via an opening in the housing.

In yet another embodiment, the fragrance tester of the invention comprises an atomizer attached to the fragrance reservoir to provide for direct spraying without stamping of the fragrance. The fragrance tester may be designed so that the atomizer replaces the pad-type fragrance dispensing, or the atomizer may be an additional component whereby the fragrance tester can perform both functions i.e. it can apply a dual stamp as detailed above and below or it may simply just provide a spray of the fragrance, which is particularly useful for fragrance manufacturers allowing them to have a single tester device to perform both kinds of sampling, otherwise they would need to have both a stamper device of the present invention as well as an atomizer sampling bottle as presently in use.

All of the embodiments of the fragrance tester of the invention are based on the well-known self-inking stamper devices, modified to provide for the aforesaid dual fragrance and ink-stamp of the invention.

The present invention also provides a method for testing fragrances comprising providing a fragrance tester according to any of the above-mentioned embodiments, and applying to a person's skin a dual stamp having a fragrance stamp and identifying logo/brand name, and/or visual image adjacent to the fragrance stamp.

These and other embodiments of the present invention are described in more detail in the following non-limiting detailed description with reference to the accompanying drawings.

BRIEF DESCRIPTION OF THE DRAWINGS

FIG. 1(*b*) is a schematic representation of the inner part of the fragrance tester depicted in FIG. 1(*a*);

FIG. 4(*b*) is a schematic depiction of the reservoir and platen of FIG. 4(*a*) when in direct contact with each other, when in the resting position of the fragrance tester of the invention;

FIG. 6(*b*) is an enlarged view of the one-way valve depicted in FIG. 5 when flow of fragrance from the fragrance reservoir is stopped when in the resting position;

FIG. 7(*b*) is a schematic depiction of the reservoir and platen of FIG. 7(*a*) when in direct contact with each other, when in the resting position of the fragrance tester of the invention.

DETAILED DESCRIPTION OF THE INVENTION

The fragrance tester of the present invention utilizes the mechanisms of the well-known self-inking devices depicted, for example, in U.S. Pat. Nos. 4,432,281 and 4,852,489 and European Patent No. EP 0803372, as well as those contained in the well-known plastic self-inking stamps with renewable/removable ink pad marketed by, for example, companies like Trodat and M & R Marking. Accordingly, the contents of the aforementioned patents are incorporated in their entirety herein as regards the mechanisms and modes of operation of these self-inking stamps and save for where necessary, these will not be described herein in detail. Likewise, all of the commercially available self-inking stamps marketed worldwide by such companies are readily available to all of skill in the art and may be readily modified to provide the fragrance testers of the present invention. As such, the basic mechanisms of these ink stamp devices will not be detailed herein.

Figure 1B:
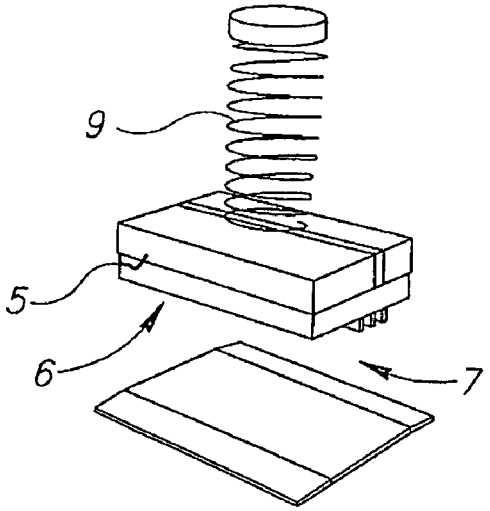
FIG. 1(*a*) is a schematic depiction of one embodiment of the fragrance tester of the present invention.
Figure 1A:
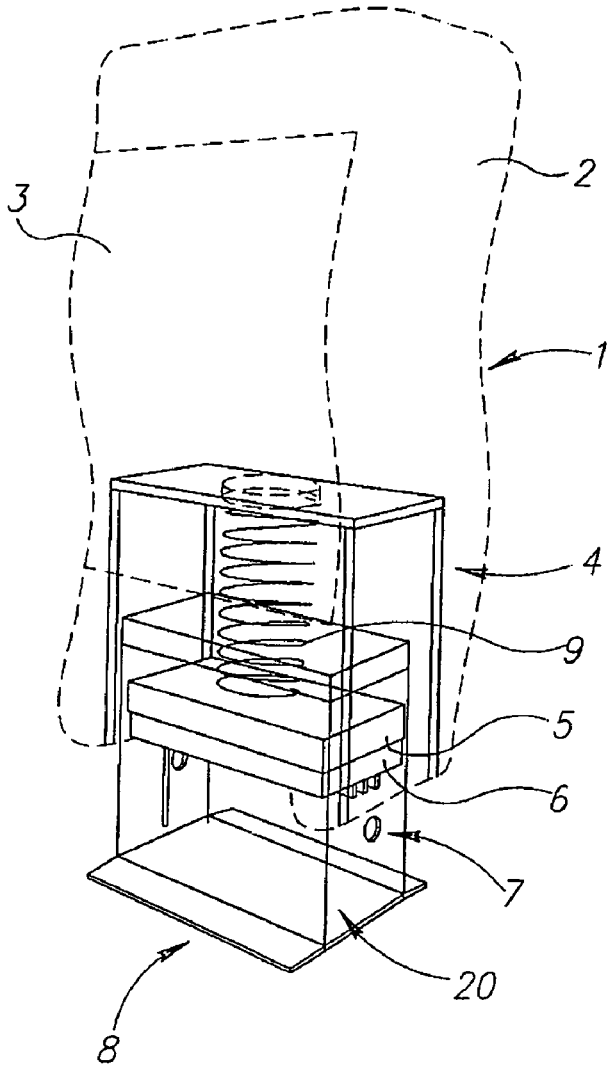
Figure 2:
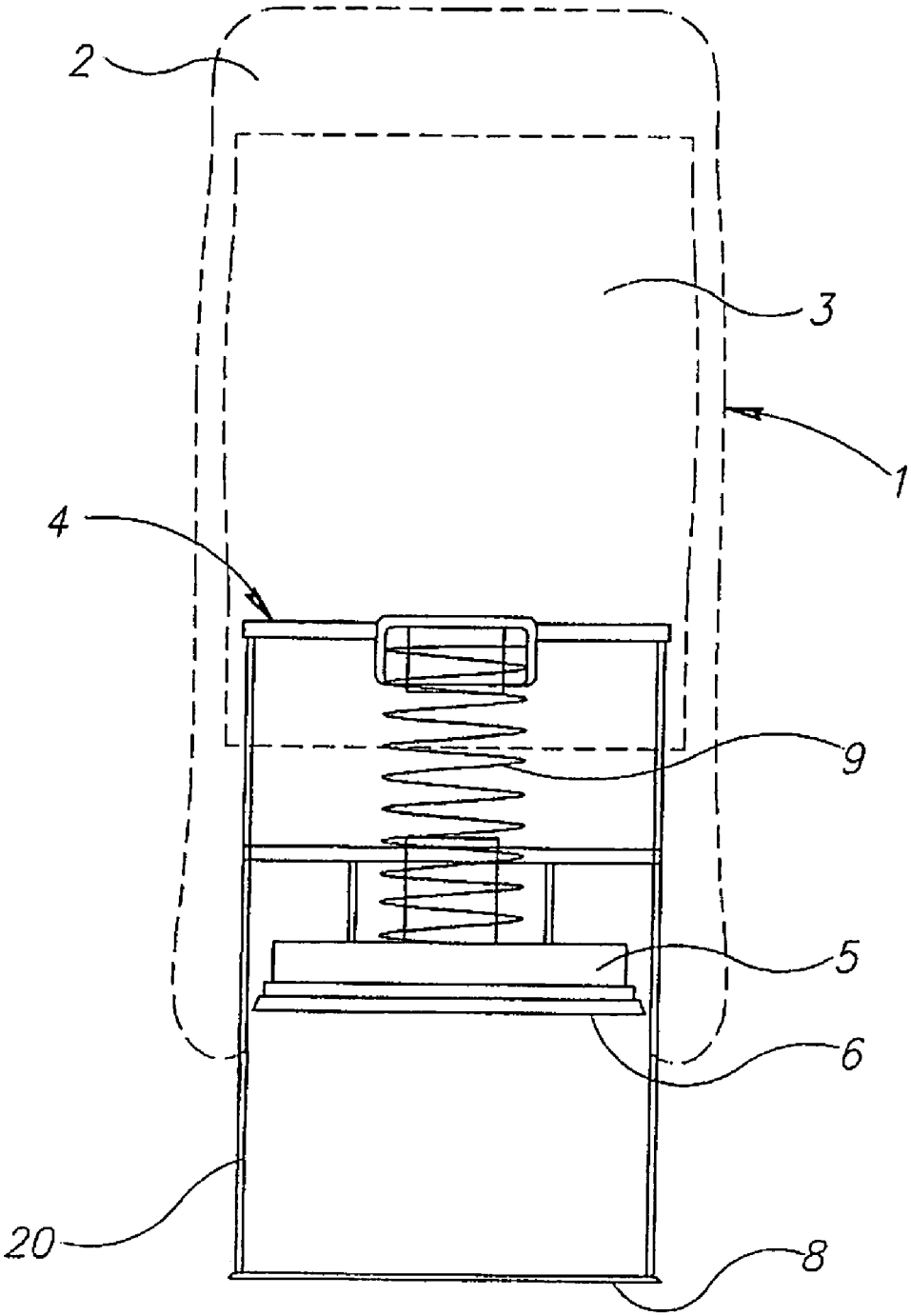
FIG. 2 is a front view of the fragrance tester depicted in FIG. 1(*a*)
Figure 3:
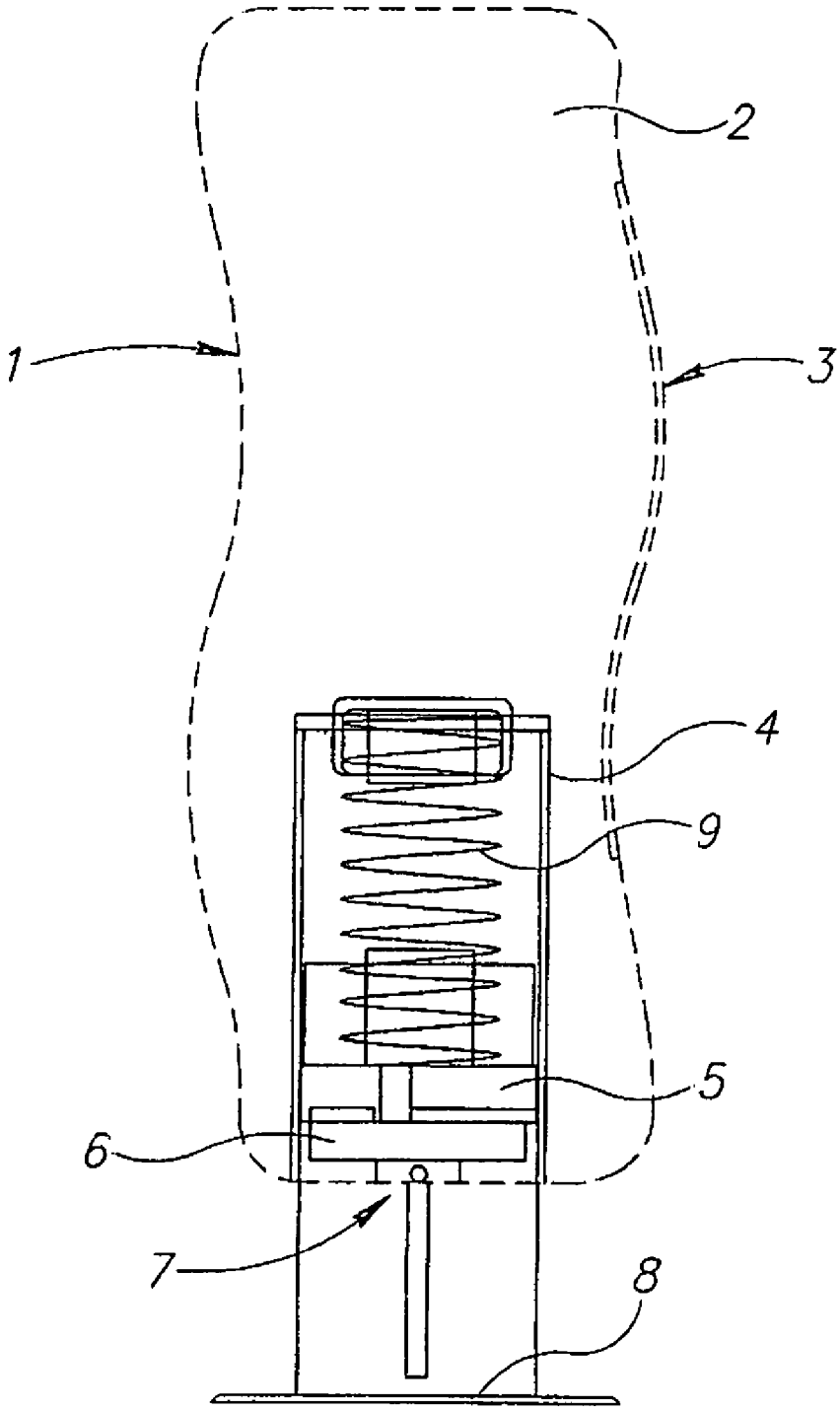
FIG. 3 is a side view of the fragrance tester depicted in FIG. 1(*a*)

Briefly, all of the aforementioned self-inking stamps, as schematically depicted in FIGS. 1-3, have a hollow housing 1, which also serves as an operating member, it being functionally attached to the frame member 4, which carries the ink pad 5, which in accordance with embodiments of the present invention is a dual ink and fragrance reservoir (and thus will use the same reference number, 5), as detailed below, and the pad-carrying platen 6, which in accordance with embodiments of the present invention is a dual type-carrying (or ink stamp-carrying) and fragrance applicator stamp-carrying platen, as detailed below. The frame member 4 also has an open base 8 which contacts the surface onto which the ink stamp, which in the present invention is a dual ink and fragrance stamp, is to be stamped. The frame member 4 may have a closed structure, where all four of its upright sides are solid. However, for ease of use, namely, for the user to be able to clearly see the area of the surface on which the stamp is to be placed, frame member 4 may be of a completely open structure comprising only solid upright members 20 as shown in FIGS. 1 and 2.

The known self-inking stamps, all modifiable in accordance with the present invention to provide the fragrance tester of the invention, have various other structural components and features not detailed herein, but detailed in, for example, the above mentioned U.S. and EP patents and readily apparent to all of skill in the art from the widely available self-inking stamps of all shapes, sizes and colors, for example, those marketed in many countries by, for example, the Trodat and M & R companies.

In operation, the self-inking stamps, or the fragrance tester of the invention, shown in FIGS. 1-3 operates by the user placing the base 8 on the surface to be stamped, applying downward pressure on the housing 1, causing bores 7 to move within their slots (not shown) in the frame member 4, which movement results in the disengagement of the movable type-carrying platen or dual type-carrying stamp and fragrance applicator pad-carrying platen 6 of the present invention, from the ink pad, or dual ink and fragrance reservoir 5 of the present invention, inversion during motion of this platen 6 and the forcing thereof downward to the base 8, through the open end thereof to stamp the ink stamp, or dual ink and fragrance stamp of the present invention, carried on that surface of the platen 6 facing the surface, onto the surface. When the platen 6 moves downwards, a spring 9 is compressed. When the user completes the stamping operation, he/she ceases the downward pressure on the housing 1 allowing it to return upwards to its initial or resting position, assisted by release of the spring 9, which causes the elevation of the platen 6 from the surface, its re-inversion to have the surface of platen 6 with the dual ink and fragrance stamps facing upwards, and being brought into its resting position in direct contact with the dual ink and fragrance reservoir 5 providing for re-inking of the ink stamp and replenishment of the fragrance on the fragrance applicator stamp so that the fragrance tester is now ready for the next stamping operation. As depicted in FIGS. 1(*a*) and (*b*), the platen 6 has protruding bores 7 which engage their slots (not shown) in the frame 4 to facilitate the inversion and re-inversion of the platen when it is caused to move downwards or when it returns upwards into the resting position.

In FIGS. 1-3 there is also depicted, schematically, an example of a possible external appearance for the housing 1 of the fragrance tester of the invention. Here an outer contour 2 of the housing 1 may be curved, in contrast to the rectangular or sometimes round or oval shape of the known ink-only stampers mentioned herein above. This feature enables fragrance manufacturers to design the housing 1 of the fragrance tester to match the shape of the containers (bottles, canisters, etc.) in which they market that particular fragrance, to allow for easy identification and enhance the purchasing experience of a new fragrance because of the "user-friendly" nature of the fragrance tester itself. In addition, the housing 1 may also carry a visual image, logo, brand name, promotional slogan, or other design feature 3 on its front face and/or its top and/or its back (not shown) also for easy identification of the fragrance it carries that is to be tested.

Figure 4A:
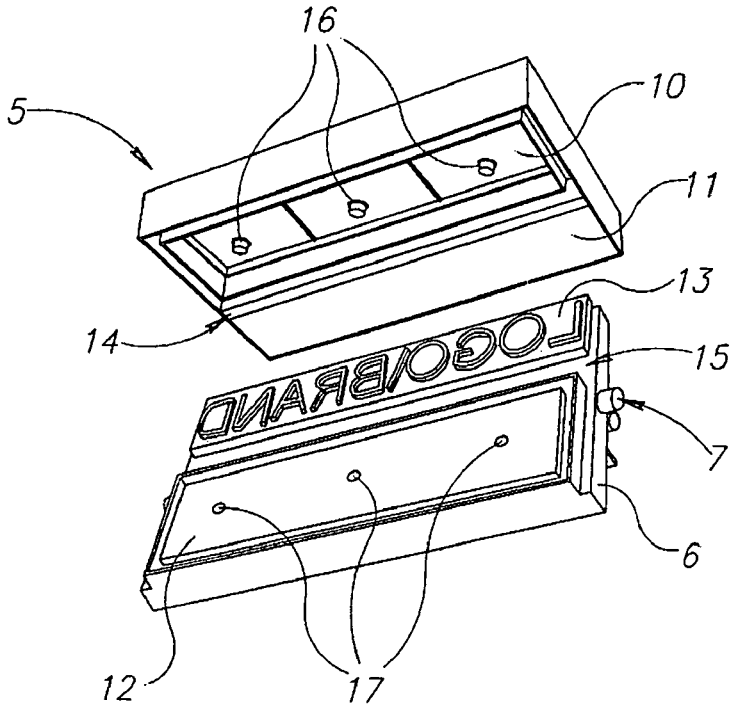
FIG. 4(*a*) is a schematic depiction of one embodiment of the dual ink and fragrance reservoir and dual ink stamp- and fragrance applicator-carrying platen of the fragrance tester of the invention in open view.
Figure 4B:
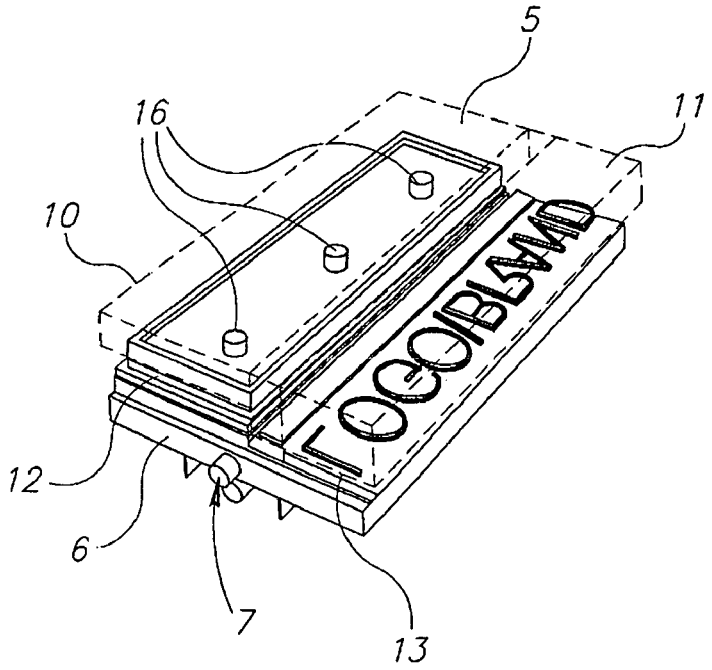

FIGS. 4(*a*) and 4(*b*) show schematically a preferred embodiment of the dual ink and fragrance reservoir 5 and dual type- or stamp-carrying and fragrance applicator-carrying platen 6 of the present invention, where FIG. 4(*a*) depicts these elements in open view and FIG. 4(*b*) depicts them in closed view, when in direct contact with each other in the resting position within the fragrance tester.

As shown in FIG. 4(*a*), the dual ink and fragrance reservoir 5 comprises an ink pad 11 soaked with ink, a fragrance reservoir 10 filled with the fragrance to be tested, and which also has a separating channel 14 to prevent mixing of the fragrance and the ink. As also shown in FIG. 4(*a*), the dual type- or stamp-carrying and fragrance applicator-carrying platen 6 comprises an ink stamp or stamp platen element 13, which will carry the logo or brand name of the fragrance to be tested, and a fragrance applicator pad 12, which will carry the fragrance to be tested, which are separated from each other to prevent mixing by a channel 15. The fragrance reservoir 10 has one-way valves 16 as depicted schematically in FIGS. 4(*a*) and 4(*b*) which serve to transfer the fragrance carried in reservoir 10 onto the fragrance applicator pad 12 of platen 6 at or near points or spots 17 shown in FIG. 4(*a*). The one-way valves 16 when brought into contact with applicator pad 12 of platen 6 when the fragrance tester is in its resting position, release fragrance from fragrance reservoir 10 onto or near specific points or spots 17 of the applicator pad 12, from which spots 17 the fragrance can diffuse to fill substantially all of the applicator pad 12, when the fragrance is replenished on applicator pad 12. The valves 16 provide for economical use of the fragrance for testing purposes, as waste of fragrance is limited. Fragrances are generally volatile and hence the use of a closed fragrance reservoir 10 with one-way valves 16 prevents unnecessary waste of fragrance, via evaporation. Valves 16 permit application of a minimal amount of fragrance as needed for a single test stamp operation around spots 17 of applicator pad 12. This further serves to prolong the supply of fragrance in reservoir 10 permitting a relatively large number of test stamps of the fragrance until it is necessary to replace or refill reservoir 10 with additional fragrance. Ideally, reservoir 10 contains sufficient fragrance for up to about 1,000 test stamps of fragrance. Once depleted the dual ink and fragrance reservoir 5 may be removed from the fragrance tester and refilled, both the fragrance and ink, or it may be replaced with a new one, the depleted one either simply discarded or recycled.

The one-way valves 16 described herein above may also be of a kind that do not release fragrance from reservoir 10 when the fragrance tester is in its resting position, but rather only at the beginning of the stamping procedure when platen 6 disassociates from contact with the dual reservoir 5, at which point the bottom portion of the valve previously closed by close contact with the fragrance applicator pad 12, is now opened and fragrance carried in the narrow tube of the valve flows out and falls onto the applicator pad 12 at or near points 17 from which it diffuses to the rest of the applicator pad 12.

In operation, when the dual ink and fragrance reservoir 5 is in direct contact with the dual stamp-carrying and fragrance applicator-carrying platen 6, when the fragrance tester is in the resting position, the platen element 13 with the logo or brand name on the platen 6 will be inked by the ink pad 11 and the fragrance applicator pad 12 will be replenished with the fragrance from the fragrance reservoir 10 via valves 16 onto spots 17 of the applicator pad 12 as detailed above. Once downward pressure is applied on the housing 1, the platen 6 will disassociate from the dual reservoir 5, invert, move downwards towards the base 8, where it will meet the surface to be stamped, usually the skin of consumer's arm, on which will be placed a double stamp (simultaneous stamping) comprising the fragrance stamp and directly adjacent thereto the logo or brand name ink stamp identifying the fragrance stamp. For each different fragrance to be tested, a different fragrance tester will be used and a series of such simultaneous double stamps may be placed on the consumer's arm, so that the consumer will now have, for example, five different fragrance stamps, each specifically identified with the brand or logo of the fragrance being tested directly adjacent to the fragrance stamp, making identification of each fragrance and the choice of the most desirable fragrance very easy.

Once the stamping operation has been completed, downward pressure on the housing 1 will be released, the platen 6 will re-invert and return to its resting position within the housing, where it will come into direct contact with the dual reservoir 5 to provide for re-inking of the logo or brand name with the ink pad and replenishment of the fragrance carrying applicator pad 12 from the fragrance reservoir 10 via the valves 16 as detailed above.

The ink stamp or platen element 13 carried by platen 6 in FIG. 4(*a*) may be constructed in the same way as any of the well-known self-inking stamps, referred to hereinabove. Likewise, the ink pad 11 carried by dual reservoir 5 in FIG. 4(*a*) may also be made in the same way and from the same materials as in any of the well-known self-inking stamp devices.

In FIG. 4(*b*), the above mentioned embodiment of FIG. 4(*a*) is also schematically depicted, this time in the closed position (the resting position within the housing) in a transparent view, from which it may be seen how the closed valves 16 are in direct contact with the applicator pad 12. In FIG. 4(*b*) it is also apparent that fragrance reservoir 10 contacts fragrance applicator pad 12 in a close-fitting manner, which serves to minimize the evaporation of fragrance when the tester is in the resting position. In fact, the outer walls of reservoir 10 serve to enclose applicator pad 12 in a close-fit manner. This serves the purpose of preventing evaporation of fragrance from pad 12 when the tester is in the resting position, as well as serving to prevent leakage of fragrance from pad 12.

Figure 5:
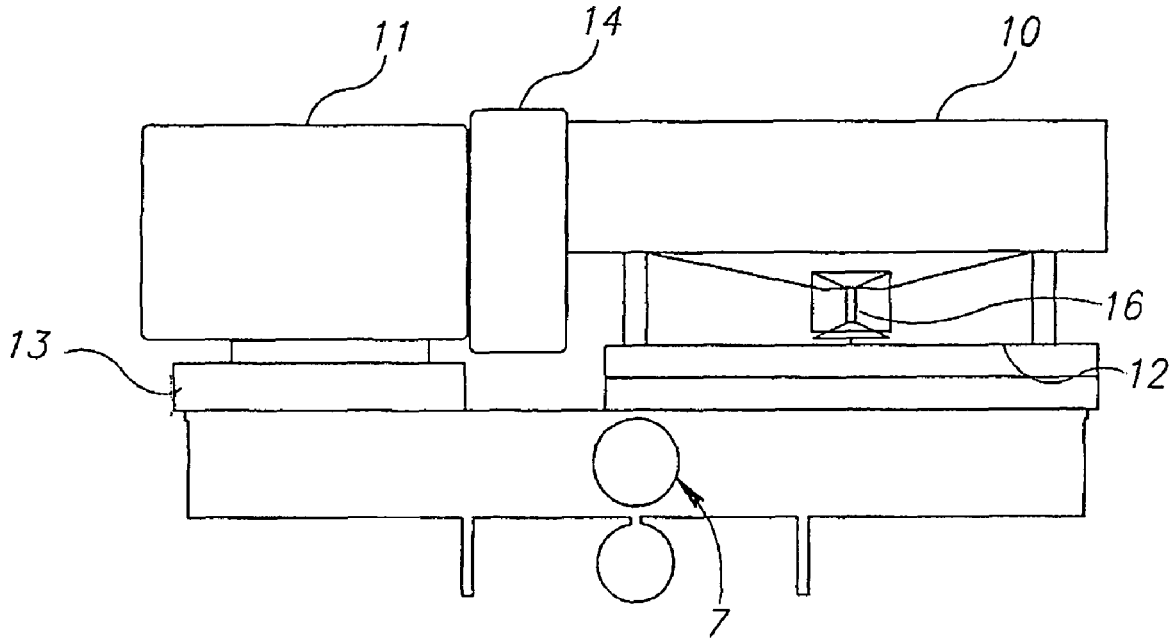
FIG. 5 is an enlarged cross-section view of the reservoirs and platen of FIG. 4(*b*), showing in more detail the one-way valve in the fragrance reservoir and the presence of a spacer member between the fragrance and ink reservoirs.

FIG. 5 depicts a schematic enlarged cross-section of the embodiment of the invention depicted in FIG. 4(*b*), in which the one-way valve 16 is observed, in a no-flow status preventing fragrance flowing from the fragrance reservoir 10 to the fragrance applicator pad 12. In addition, also depicted in FIG. 5 is an optional spacer member 14 placed between the ink pad 11 and fragrance reservoir 10 in the channel 15 (shown in FIG. 4(*a*), which spacer serves to prevent any possible undesirable outflow of ink from ink pad 11 towards the fragrance reservoir 10 or fragrance applicator pad 12, when the tester is in its resting position.

Figure 6A:
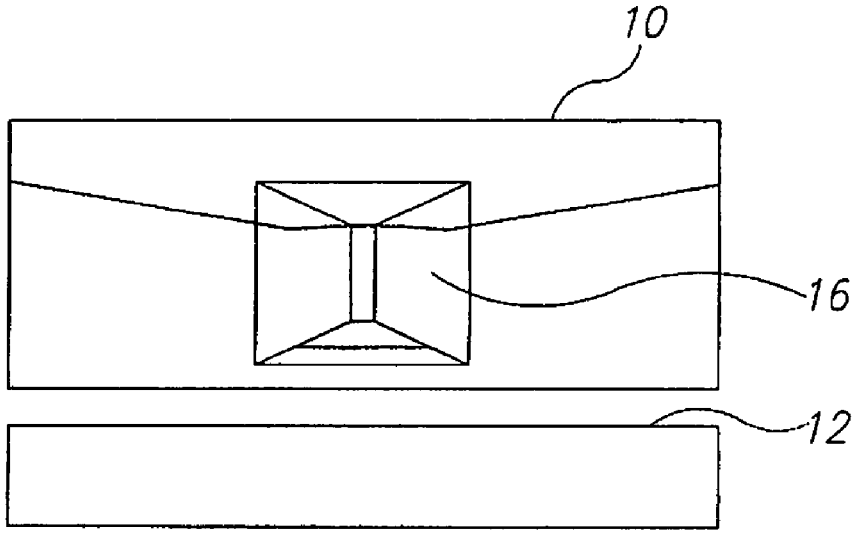
FIG. 6(*a*) is an enlarged view of the one-way valve depicted in FIG. 5 when supplying fragrance to a fragrance applicator pad.
Figure 6B:
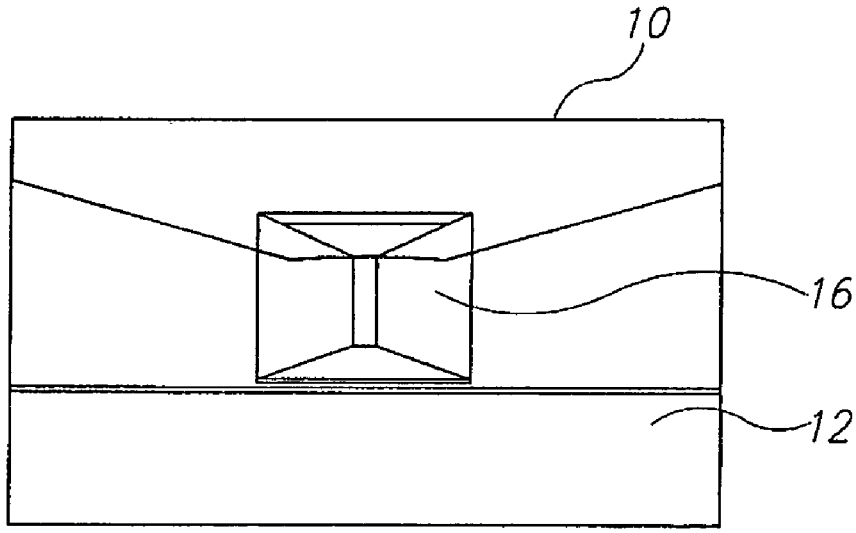

FIGS. 6(*a*) and 6(*b*) depict the one-way valves 16 in enlarged view, showing the possibility of two modes (flow/no-flow) of fragrance from the fragrance reservoir 10 onto the fragrance applicator pad 12: flow of fragrance from the central cylinder of the valve when the applicator or pad 12 is lowered (FIG. 6(*a*)); and no flow of fragrance from reservoir 10 to applicator pad 12 when in its resting position (FIG. 6 (*b*)).

Figure 7A:
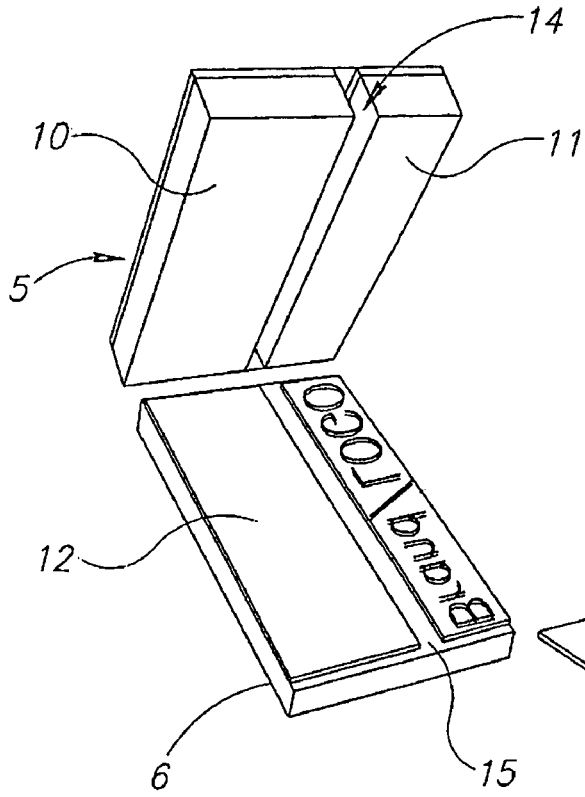
FIG. 7(*a*) is a schematic depiction of another embodiment of the dual ink and fragrance reservoir and dual ink stamp- and fragrance applicator-carrying platen of the fragrance tester of the invention in open view.
Figure 7B:
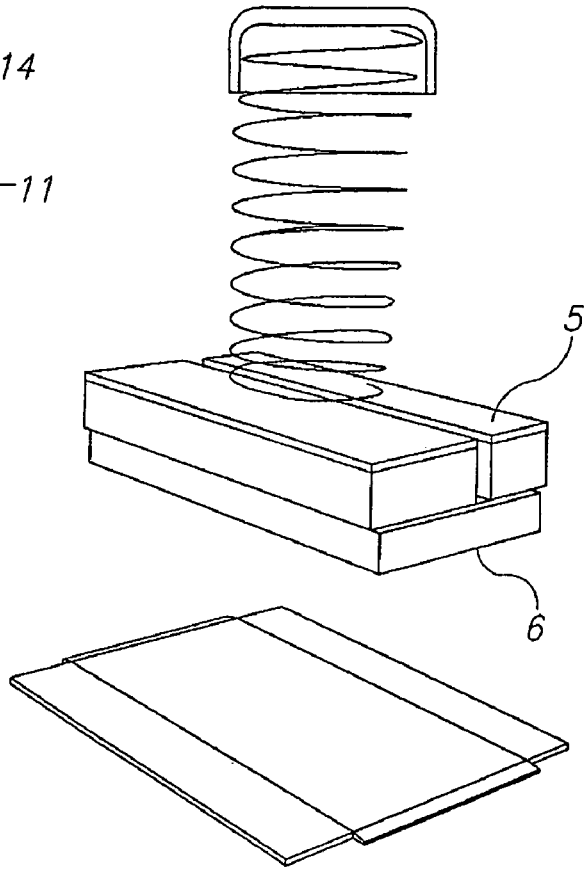

Another preferred embodiment of the present invention is depicted in FIGS. 7(*a*) and 7(*b*). In this embodiment, which differs from the embodiment of FIGS. 4(*a*) and 4(*b*) (as well as FIGS. 5, 6 (*a*) and 6 (*b*)), only as regards the fragrance reservoir 10, the fragrance reservoir 10 comprises any absorbent material into which may be absorbed an amount of fragrance that will provide for at least about 50-100 applications, and depending on the volume of the reservoir it may even provide for up to about 1,000 applications, before it needs to be replaced or refilled. The absorbent material may be natural, such as compressed cotton wool or the like, or synthetic, such as the various foams and the like which can absorb and afterwards impart upon pressure the fragrance carried by the applicator pad 12 onto the arm of the individual. This embodiment is particularly useful when a fragrance tester is to be used for a limited number of tests or when intended as a promotional item, which may be later discarded. The rest of the components of the tester according to this embodiment and the workings thereof are essentially as detailed herein above with regards to the embodiment of FIGS. 4(*a*) and 4(*b*).

A further preferred embodiment of the present invention, not depicted in the drawings is a modification of the newest pre-inked stamping devices marketed by such companies, for example Trodat and M & R Marking. These new devices have a stamp platen which is filled from its top at one or at a number of points with the ink, into an ink reservoir. During stamping ink passes through tiny pores within the letters or other components of the stamp e.g. logos or the like, and when the stamp is applied to a surface, the letters or other characters carried by the stamp platen are inked and permit the stamping of the letters or other characters onto the surface. The more pressure is applied during the stamping procedure, the darker the stamp imprint on the surface will be, this being controlled by the user. The advantages of such devices are that they are very economical regarding the ink usage, do not require replacement and are simply refilled when the ink supply is depleted. Details of the construction and working of these devices may be readily obtained at the Internet web sites of for example, the Trodat company; http://www.trodat.net., specifically the pre-inking device pages, as well as the M & R Marking Company; http://www.mrmarking.com/rmpreink.html, as well as other web pages of that company relating to their various different stamping devices the contents thereof being included herein by reference. In accordance with the present invention such new pre-ink devices may be readily modified to provide the fragrance tester of the invention by replacing the ink stamp platen with a dual ink and fragrance platen, separated by spacers or the like as detailed herein above with reference to FIGS. 4(*a*) and 4(*b*), to prevent any mixing of the ink and fragrance. Likewise, the ink reservoir of these devices will be replaced by a dual ink and fragrance reservoir, each having its separate inlets for either ink or fragrance. This modification will provide for a dual ink and fragrance prefilled device which will function as the fragrance tester in accordance with the present invention.

Although not depicted in the embodiments of the invention shown in FIGS. 1-7, with respect to the ink stamp 13 inked by pad 11, the ink stamp 13 and correspondingly the ink pad 11 may be divided, to provide for more than one color for the logo or brand name, to identify the fragrance. This may be done by placing a channel in each of the ink stamp 13 and pad 11, analogous to the channels 14 and 15 depicted in FIG. 4(*a*), so that it will be possible for a logo in one color and the printed name in another color. Furthermore, in the dual ink and fragrance reservoir 5 and corresponding stamp- and fragrance applicator-carrying platen 6 there is depicted in the embodiments shown in FIG. 4(*a*) and FIG. 7(*a*) that the logo/brand name, when used for stamping, will stamp the logo/brand name either above or below the fragrance stamp on the person's skin. This is just an example, but it should be appreciated that the division may be such that the stamping will be such that the logo/brand name will be to the left or the right of the fragrance stamp.

Regarding the ink to be used for the ink stamp of the fragrance tester, it should be appreciated that because it is to be applied to a person's skin, it should not be of a permanent ink type, rather it should be any of the known washable inks that may be readily removed once the person has completed the testing of a number of fragrances, so that their arm would not be labeled for any extended time with a number of different logos, which may be undesirable to many people. In this respect, it is also possible to have fluorescent ink or the like, that is invisible when stamped onto the person's arm, but becomes visible once the arm is placed under a ultra-violet lamp/light or the like, depending on the type of "invisible" ink chosen.

It should be noted that the ink pad 11 of dual reservoir 5 described herein above with respect to the preferred embodiments of the invention, as depicted in FIGS. 1-7, may be a reservoir filled with liquid ink instead of a soaked/filled pad, and may also have valves or the like to regulate the flow of ink onto the ink stamp 13 of dual platen 6, which would also serve to prevent wasting of ink and possible overflow and subsequent smudging due to too much ink being applied onto stamp 13.

The embodiments of the present invention, as discussed with respect to FIGS. 4(*a*) and 7(*a*) above, regarding the dual ink and fragrance reservoir 5 and its complementary ink stamp and fragrance applicator-containing platen 6, do not include illustration of the possibility of having the reservoir 5 being in the form of a replaceable cartridge which may be inserted/removed from the frame 4 enclosed within housing 1 depicted in FIGS. 1-3. It is a further embodiment of the present invention that the reservoir 5 may be in the form of a removable cartridge, like the type widely available for self-inking stamps sold by companies, for example the Trodat company and M & R Marking Company. With such a removable cartridge, it is readily possible to either discard a depleted cartridge and replace it with a new one, or to recycle it by replenishing such a depleted cartridge, with both ink and fragrance.

While the present invention has been described primarily regarding the fragrance tester for utilization by fragrance producers, who will supply the various outlets, such as perfumeries, department stores, pharmacies, duty free shops, etc., where fragrances are sold, with the different fragrance testers for each brand of fragrance, it is to be appreciated that the fragrance tester of the present invention may have various other commercial uses. For example, fragrance testers carrying a small sample of a new fragrance may be mass produced and circulated amongst potential new buyers for that fragrance, thereby serving as a sales promotion device. Another use could be as a novelty item for youngsters that may be sold in various novelty or gift shops. A further use of these fragrance testers could be as a complimentary gift to be distributed by owners of dance clubs, discos and the like to their regular clients, which fragrance testers would carry the logo of such places of entertainment. In this vein, as is common, many such places of entertainment have selectors at their entrances, often stamping those clients who have been permitted to enter with their logo, so that it is now possible to provide such places with a fragrance tester of the present invention to enable them to provide a more pleasant stamp to their clients upon entry, one having a pleasant fragrance besides the logo. Likewise, the logo may also be that of a company which is sponsoring the entertainment at the aforesaid place of entertainment. In addition, the fragrance tester of the present application may also be used to promote new food products coming onto the market in which case the fragrance will be that of the food product and the stamp will be the logo/brand name of the new food product. Likewise, the fragrance tester of the present invention may also be used to promote sales of chewing gum, toys, new movies and the like, each such promotion having the logo/brand name/movie name or the like, as the stamp to be applied together with an associated appropriate fragrance, which would result in a pleasant association in the mind of the consumer towards the newly promoted chewing gum, toy, movie or the like.

Another possible modification of the fragrance tester of the present invention as described hereinabove and as depicted, for example, in FIGS. 1-7, is to attach an atomizer to the fragrance reservoir 10 of the dual reservoir 5 to provide for the possibility of simply spraying a sample of the fragrance onto a person's arm, without actually stamping the fragrance together with the identifying logo/brand name/visual image/etc. This is particularly desirable for those consumers who would not wish to receive a stamp on their arm and who are only interested in sampling one or two fragrances. This is also particularly desirable for fragrance producers in that a single fragrance tester according to the present invention would be able to carry out the fragrance testing in two distinct ways, without the need for two different fragrance testers, one according to the invention and the other as is presently in use, namely the atomizer sampling canisters/bottles.

While the present invention has been detailed hereinabove with reference to the drawings, it is to be appreciated that the described embodiments represent non-limiting examples of fragrance testers of the invention and that the invention as defined in the following claims encompasses many other possible constructions of the fragrance tester and methods of applying a fragrance, as is apparent to all of skill in the art.

The invention claimed is:

1. A stamp device in the form of a fragrance tester comprising a visible indication mechanism and a fragrance applicator, the stamp device configured for performing a stamping operation comprising applying a visible indication by said mechanism together with applying a fragrance by said fragrance applicator, said stamp device adapted to apply said fragrance in proximity to said visible indication so as to identify said fragrance.

2. The fragrance tester according to claim 1, wherein the tester is adapted so that a downward pressure thereon applies the fragrance and visible indication.

3. A fragrance tester according to claim 1, wherein said tester comprises a fragrance applicator pad and ink stamp with a corresponding fragrance reservoir and ink pad.

4. A fragrance tester according to claim 3, wherein the fragrance reservoir and ink pad face a surface to be stamped, and the corresponding fragrance applicator pad and ink stamp are below said fragrance reservoir and ink pad, and said fragrance applicator pad and ink stamp are moved to face said surface upon application of the fragrance and visible indication.

5. The fragrance tester according to claim 3, wherein the fragrance applicator pad and ink stamp are moved to the surface to be stamped by a stamper device having a movable housing functionally connected to a frame member and containing a spring, said frame member carrying the fragrance reservoir and ink pad directly in contact with an invertibly movable fragrance applicator pad and ink stamp, when said fragrance tester is in a resting position with said spring being in its resting position, said frame member have a base member with an opening, wherein when a stamping operation is performed said housing is forced downwards by a user applying downward pressure causing said fragrance reservoir and said ink pad to disassociate from said fragrance reservoir and ink pad to invert and to move downwards until opening in said base where it meets said surface upon which said base is placed, to stamp said fragrance and ink in proximity of each other on said surface.

6. The fragrance tester according to claim 5, wherein the housing is in the shape of a container or canister in which the fragrance being tested by said tester is usually marketed.

7. The fragrance tester according to claim 5, wherein the housing comprises on its front and/or top and/or back side a logo and/or visual image or picture and/or brand name and/or promotional slogan of the fragrance which is being tested by said tester.

8. The fragrance tester according to claim 5, wherein the fragrance reservoir and ink pad are in the form of a removable cassette, which is inserted/removed via an opening in the housing.

9. The fragrance tester according to claim 3, wherein between the fragrance reservoir and ink pad is disposed a channel to prevent mixing of ink and fragrance.

10. The fragrance tester according to claim 9, wherein a spacer is placed in said channel between the ink and fragrance reservoirs to prevent of ink and fragrance.

11. The fragrance tester according to claim 3, wherein the fragrance applicator pad and ink stamp have a channel therebetween, preventing mixing of fragrance and ink are applied to the surface.

12. The fragrance tester according to claim 3, wherein the fragrance reservoir of said fragrance reservoir carries one or more one-way valves for applying fragrance onto the fragrance applicator.

13. The fragrance tester according to claim 3, wherein the ink to be used on the ink stamp is a non-permanent ink of a readily washable type.

14. The fragrance tester according to claim 3, wherein the ink is of an invisible type, not visible under normal lighting, but visible once placed under an ultra-violet light/lamp.

15. The fragrance tester according to claim 1, wherein the fragrance applicator comprises an atomizer for applying the fragrance.

16. A method for testing fragrances by means of a fragrance tester, comprising the steps of:

applying a fragrance by means of applying a downward pressure on a fragrance applicator of the fragrance tester; and applying a visible indication together with and in the proximity to said fragrance by means of a mechanism of said fragrance tester, so as to identify said fragrance, wherein said fragrance tester comprises a fragrance applicator pad and ink stamp with a corresponding fragrance reservoir and ink pad.

17. The method according to claim 16, wherein the fragrance reservoir and ink pad face a surface to be stamped, and the corresponding fragrance applicator pad and ink stamp are below said fragrance reservoir and ink pad, and said fragrance applicator pad and ink stamp are moved to face said surface upon application of the fragrance and visible indication.

18. The method according to claim 16, wherein the fragrance applicator pad and ink stamp are moved to the surface to be stamped by a stamper device having a movable housing functionally connected to a frame member and containing a spring, said frame member carrying the fragrance reservoir and ink pad directly in contact with an invertibly movable fragrance applicator pad and ink stamp, when said fragrance tester is in a resting position with said spring being in its resting position, said frame member having a base member with an opening, wherein when a stamping operation is performed said housing is forced downwards by a user applying downward pressure causing said fragrance reservoir and said ink pad to disassociated from said fragrance reservoir and ink pad to invert and to move downwards until opening in said base where it meets said surface upon which said base is placed, to stamp said fragrance and ink in proximity of each other on said surface.

19. The method according to claim 18, wherein the housing is in the shape of a container or canister in which the fragrance being tested by said tester is usually marketed.

20. The method according to claim 18, wherein the housing comprises on its front and/or top and/or back side a logo and/or visual image or picture and/or brand name and/or promotional slogan of the fragrance which is being tested by said tester.

21. The method according to claim 18, wherein the fragrance reservoir and ink pad are in the form of a removable cassette, which is inserted/removed via an opening in the housing.

22. The method according to claim 16, wherein between the fragrance reservoir and ink pad is disposed a channel to prevent mixing of ink and fragrance.

23. The method according to claim 22, wherein a spacer is place in said channel between the ink and fragrance reservoirs to prevent mixing of ink and fragrance.

24. The method according to claim 16, wherein the fragrance applicator pad and ink stamp have a channel therebetween preventing mixing of fragrance and ink applied to the surface.

25. The method according to claim 16, wherein the fragrance reservoir of said fragrance reservoir carries one or more one-way valves for applying fragrance onto the fragrance applicator.

26. The method according to claim 16, wherein the ink to be used on the ink stamp is a non-permanent ink of a readily washable type.

27. The method according to claim 16, wherein the ink is of an invisible type, not visible under normal lighting, but visible once placed under an ultra-violet light/lamp.

28. The method according to claim 16, wherein the fragrance applicator comprises an atomizer for applying the fragrance.

* * * * *